US006162598A

United States Patent [19]

Tang et al.

[11] Patent Number: 6,162,598

[45] **Date of Patent: *Dec. 19, 2000**

[54] SILVER HALIDE PHOTOGRAPHIC ELEMENT CONTAINING IMPROVED YELLOW DYE-FORMING COUPLER

[75] Inventors: Ping-Wah Tang, Yorktown Heights; Robert G. Cameron, Spencerport, both of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/217,588

[22] Filed: Dec. 22, 1998

[51] Int. Cl.[7] ..... G03C 1/08

[52] U.S. Cl. ..... 430/557; 430/543

[58] Field of Search ..... 430/543, 557

[56] References Cited

U.S. PATENT DOCUMENTS

| | | | |
|---|---|---|---|
| 4,022,620 | 5/1977 | Okummura et al. | 430/557 |
| 4,401,752 | 8/1983 | Lau | 430/557 |
| 4,791,050 | 12/1988 | Ogawa et al. | 430/506 |
| 5,427,898 | 6/1995 | Tang et al. | 430/557 |

FOREIGN PATENT DOCUMENTS 0 897 133 A1 2/1999 European Pat. Off. .

OTHER PUBLICATIONS

XP–000885148, "Solvent Control of Coupling Activity in Microcrystalline Coupler Dispersions"by John Texter, "IS&T's 47th Annual Conference/ICPS 1994, Vol. 1" pp. 344–348, IS&T Society for Imaging Science and Technology, Springfield, VA.

*Primary Examiner*—Geraldine Letscher
*Attorney, Agent, or Firm*—Arthur E. Kluegel

[57] ABSTRACT

A color photographic element includes a support, a silver halide emulsion layer, and associated therewith a yellow dye-forming coupler having the formula wherein $R^1$ represents a tertiary alkyl group containing 4 to about 20 carbon atoms; $R^2$ represents an alkyl, aryl, or heterocyclic group; X represents hydrogen or a substituent; Y and Z each independently represent a group consisting of those substituents having a Hammett $sigma_{para}$ constant greater than zero; and m and n is each 1 to 4.

12 Claims, No Drawings

SILVER HALIDE PHOTOGRAPHIC ELEMENT CONTAINING IMPROVED YELLOW DYE-FORMING COUPLER

FIELD OF THE INVENTION

This invention relates to color photography and, more particularly, to a color photographic element containing a yellow dye-forming coupler that displays enhanced coupling activity and produces a dye having improved dark/wet image stability.

BACKGROUND OF THE INVENTION

A typical color photographic element contains multiple layers of light-sensitive photographic silver halide emulsions, where one or more of these layers is spectrally sensitized to blue light, green light, and red light, respectively. The blue, green, and red light sensitive layers will typically contain, respectively, yellow, magenta, and cyan dye-forming couplers.

For forming color photographic images, the color photographic element is exposed imagewise and processed in a color developer bath containing an aromatic primary amine color developing agent. Generally, image couplers are selected to provide dyes showing good stability to heat and light and having an absorption spectrophotometric curve with a suitable peak absorption and low unwanted side absorptions, which results in color photographic images with good color reproduction.

The present invention is directed to yellow couplers that yield dyes of improved stability, particularly to conditions of elevated heat and humidity. Couplers that form yellow dyes upon reaction with oxidized color developing agents, typically open chain ketomethylene compounds, are described in such representative patents and publications as U.S. Pat. Nos. 2,298,443; 2,407,210; 2,875,057; 3,048,194; 3,265,506; 3,447,928; 4,022,620; and 4,443,536; "Farbkupplereine Literatur Ubersicht," published in Agfa Mitteilungen, Band III, pp 112–126 (1961); T. H. James, editor, *The Theory of the Photographic Process,* Macmillan, N.Y., 1977, pages 354–356; and *Research Disclosure* No. 365, Item 36544, September 1994, Section X-B(6).

A problem to be solved is to provide yellow dye-forming couplers with high coupling activity and improved stability, in particular, resistance to degradation under conditions of high heat and/or humidity.

SUMMARY OF THE INVENTION

The present invention is directed to a color photographic element comprising a support, a silver halide emulsion layer, and associated therewith a yellow dye-forming coupler having the formula

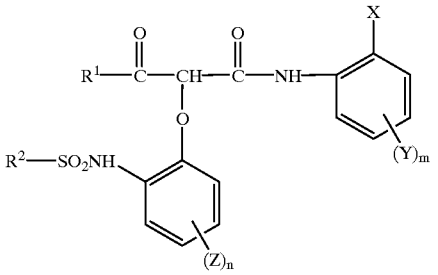

wherein $R^1$ represents a tertiary alkyl group containing 4 to about 20 carbon atoms;

$R^2$represents an alkyl, aryl, or heterocyclic group;

X represents hydrogen or a substituent;

Y and Z each independently represent a group consisting of those substituents having a Hammett $sigma_{para}$ constant greater than zero; and m and n is each 1 to 4.

The yellow couplers in the silver halide photographic element of the present invention exhibit high coupling activity and yield dyes having improved dark/wet image stability.

DETAILED DESCRIPTION OF THE INVENTION

In accordance with the present invention, a color photographic element includes a yellow dye-forming coupler having the formula

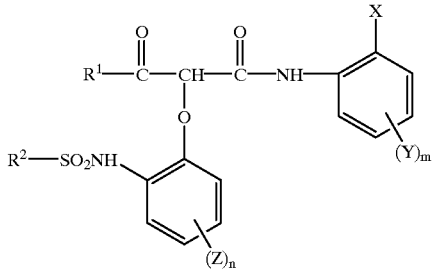

wherein $R^1$ represents a tertiary alkyl group containing 4 to about 20 carbon atoms;

$R^2$ represents an alkyl, aryl, or heterocyclic group;

X represents hydrogen or a substituent;

Y and Z each independently represent a group consisting of those substituents having a Hammett $sigma_{para}$ constant greater than zero; and m and n is each 1 to 4.

In the couplers of the present invention, the tertiary alkyl group represented by $R^1$ can include a cyclohexyl substituent. Preferably, $R^1$ represents a tertiary butyl group. $R^2$ preferably represents an alkyl group containing 1 to about 8 carbon atoms or an aryl group containing 6 to about 10 carbon atoms.

Also in the couplers of the present invention, X preferably represents hydrogen or a substituent selected from the group consisting of halogen, an alkoxy group, or a cycloalkoxy group. More preferably, X represents chlorine or a methoxy group.

Y and Z in the couplers of the present invention each independently represent a group consisting of those substituents having a Hammett $sigma_{para}$ constant greater than zero, preferably +0.2 or greater. Hammett sigma values for a great many substituents are listed in Hansch et al., "'Aromatic' Substituent Constants for Structure-Activity Correlations" in *Journal of Medicinal Chemistry,* 1973, Vol. 16, No. 11, pp 1207–1216. In general, substituents whose $sigma_{para}$ values are greater than zero have an electron- withdrawing effect relative to hydrogen. Thus, Y and Z arc each electron-withdrawing.

In the couplers of the present invention, Y preferably represents a substituent selected from the group consisting of a carboalkoxy group, a carbamoyl group, a sulfamoyl group, and a cyano group. More preferably, Y represents a carboalkoxy group containing up to about 20 carbon atoms. Z preferably represents a substituent selected from the group consisting of a carboalkoxy group, a carbamoyl group, a sulfamoyl group, a trifluoromethyl group, and halogen. More preferably, Z represents a carboalkoxy group containing up to about 8 carbon atoms. Preferably, m and n are each equal to 1.

Examples of couplers of the present invention, are listed in Table 1.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonyl amino, 2,4-di-t-butylphenoxycarbonylamino, phenylcarbonylamino, 2,5-(di -t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphcnyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye- forming coupler, a magenta dye image-forming unit comprising at least one green- sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in Research Disclosure, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling- off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp.126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960;

4,871,652; 4,876,182; 4,892,805; 4,900,657; 4,910,124; 4,914,013; 4,921,968; 4,929,540; 4,933,465; 4,942,116; 4,942,117; 4,942,118; U.S. Patent 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 25 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

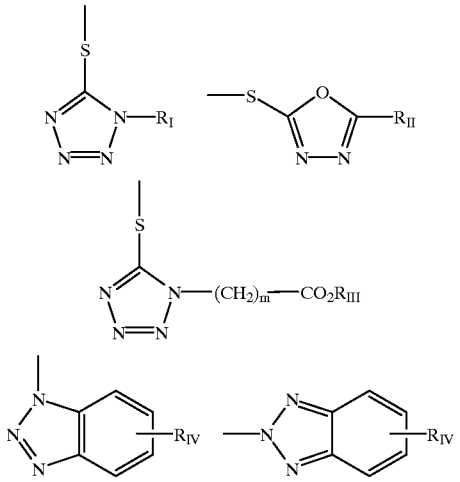

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —COORV and —NHCOORV wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

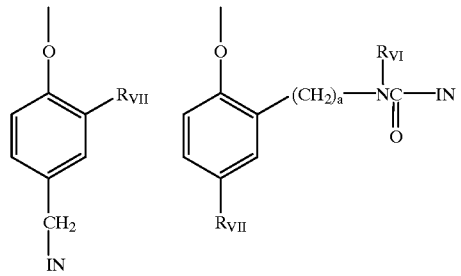

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

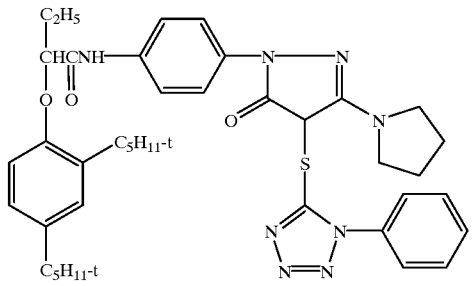

-continued
D2
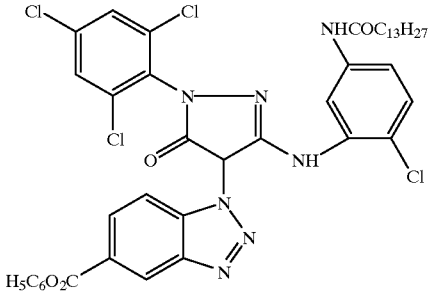
D3
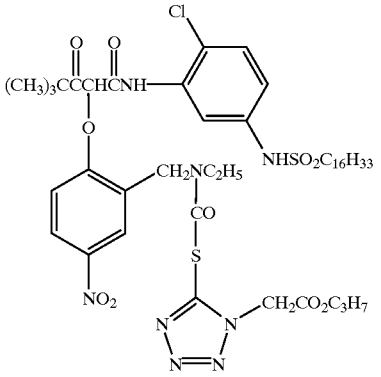
D4
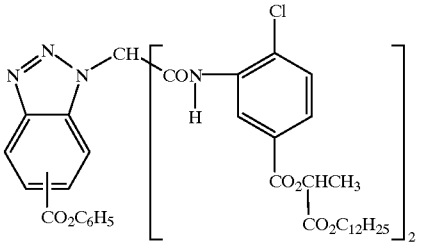
D5
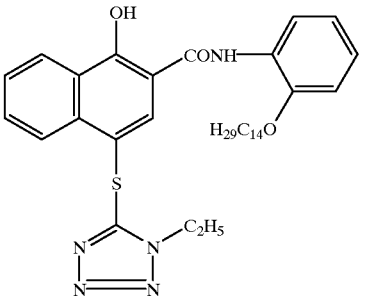
-continued
D6
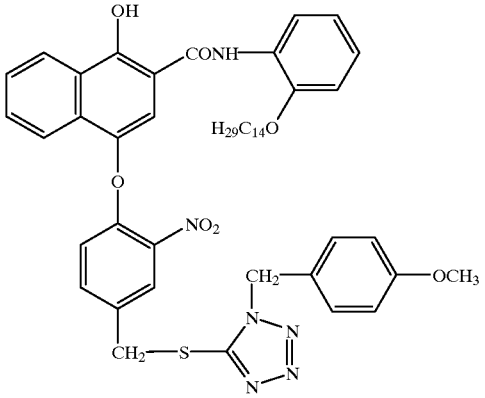
D7
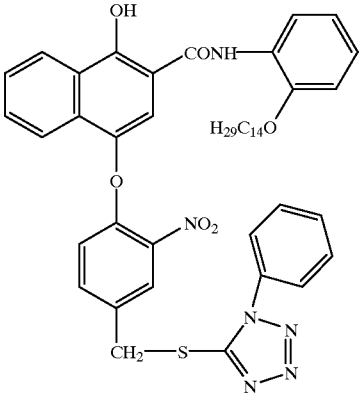
D8
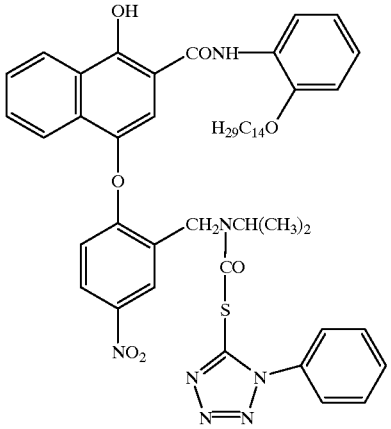

-continued

D9

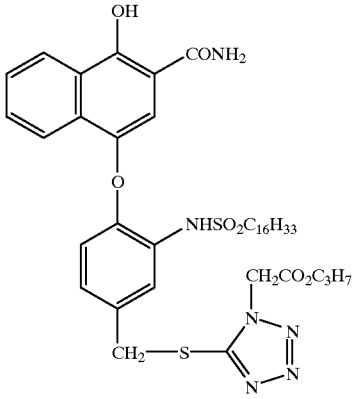

D10

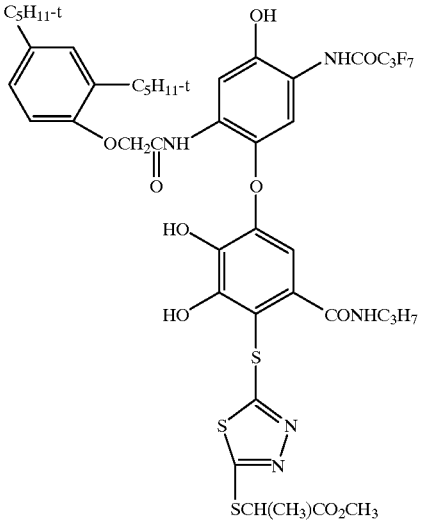

D11

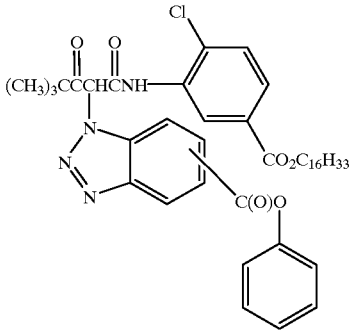

-continued

D12

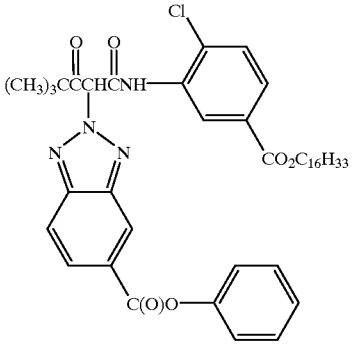

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-15 080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Conventional radiation-sensitive silver halide emulsions can be employed in the practice of this invention. Such emulsions are illustrated by Research Disclosure , Item 38755, September 1996, 1. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501,, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. If desired "Redox Amplification" as described in Research Disclosure XVIIIB(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)ani line sulfate, 4-amino-3-(2-methanesulfonamidoethyl)-N,N-diethyl aniline hydrochloride, and 4-amino-N-ethyl-N-(2-methoxyethyl)-in-toluidine di-p-toluene sulfonic acid.

Development is usually followed by the conventional steps of bleaching, fixing, or bleach-fixing, to remove silver or silver halide, washing, and drying.

The entire contents of the patents and other publications referred to in this specification are incorporated herein by reference.

Coupler Synthesis

The synthesis of the couplers of the invention are accomplished using conventional reactions. Following is the synthetic scheme and procedure for the preparation of coupler Y-1. Other couplers of the invention can be prepared by analogous methods.

Hexadecyl 3-[3-t-butyl-2-chloro-3-oxopropanamido]-4-chlorobenzoate (2)

To a suspension of 52.22 g (0.1 mol) of hexadecyl 3-[3-t-butyl-3-oxopropanamido]-4-chlorobenzoate 1 in 350 mL of $CH_2Cl_2$ was added 13.52 g (0.1 mol) of $SO_2Cl_2$. The mixture was gently refluxed for one hr, then stirred at room temperature for 0.5 hr. The solvent was removed under vacuum to yield a solid that was washed with ligroin and dried. There was thus obtained 52.62 g (94.5% yield) of 2, which was used in the following step.

Methyl 4-(1-[(2-chloro-5-[hexadecyloxycarbonyl]anilino)carbonyl]-3,3-dimethyl-2-oxobutoxy)-3-(methanesulfonamido)-benzoate (Y-1)

A suspension of 8.35 g (15 mmol) of 2, 3.68 g (15 mmol) of methyl 4-hydroxy-3-(methanesulfonamido)-benzoate 3 and 6.22 g (45 mmol) of potassium carbonate in 180 mL of acetone was heated at reflux overnight. Thin layer chromatographic analysis indicated reaction was complete. The solvent was removed under vacuum to near dryness, and the residue was treated with a mixture of ethyl acetate and water. The organic liquid phase was washed with dilute hydrochloric acid and then with brine, and then concentrated under vacuum to an oil. The crude product was purified by column chromatography on silica gel using an elution solvent of 30 volume percent ethyl acetate in ligroin. There was thus obtained 7 g (61% yield ) of coupler Y-1.

Comparison coupler used in the evaluation of the present invention are listed in Table II.

TABLE 1

Exemplary Couplers of the Present Invention

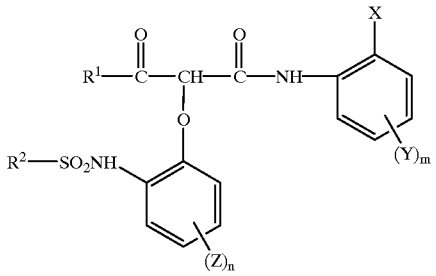

| Coupler | $R^1$ | $R^2$ | X | Y | Z |
|---|---|---|---|---|---|
| Y-1 | $(CH_3)_3C$ | $CH_3$ | Cl | 5-$CO_2C_{16H}33$ | 4-$CO_2CH_3$ |
| Y-2 | $(CH_3)_3C$ | $C_2H_5$ | Cl | 5-$CO_2C_{12}H_{25}$ | 4-$CO_2C_2H_5$ |
| Y-3 | $(CH_3)_3C$ | $C_8H_{17}$ | Cl | 5-$CO_2C_{12}H_{25}$ | 4-$CO_2CH_3$ |
| Y-4 | $(CH_3)_3C$ | $C_2H_5$ | H | 4-$SO_2NHC_{16}H_{33}$ | 4-$CO_2C_3H_7$ |
| Y-5 | $(CH_3)_3CCH_2C—(CH_3)_2$ | $CH_3$ | Cl | 5-$CO_2C_{16}H_{33}$ | 4-$CO_2CH_3$ |
| Y-6 | $(CH_3)_3C$ | $CH_3$ | Cl | 5-$CO_2C_{12}H_{25}$ | 4-$CO_2C_2H_5$ |
| Y-7 | (cyclo-$C_6H_{11}$)$C(CH_3)_2$ | $CH_3$ | Cl | 5-$CO_2C_{12}H_{25}$ | 5-$CF_3$ |
| Y-8 | (cyclo-$C_6H_{11})_2CCH_3$ | $CH_3$ | H | 4-CN | 4-$CO_2C_{12}H_{25}$ |
| Y-9 | $(CH_3)_3C$ | $CH_3$ | Cl | 5-$CONHC_{18}H_{37}$ | 4-CN |
| Y-10 | $(CH_3)_3C$ | $CH_3$ | Cl | 5-$CON(C_{10}H_{21})_2$ | 4-$CO_2CH_2C_6H_5$ |
| Y-11 | $(CH_3)_3C$ | $C_6H_5$ | Cl | 5-$CO_2C_{12}H_{25}$ | 4-$CO_2C_2H_5$ |
| Y-12 | $(CH_3)_3C$ | $CH_3$ | $CH_3O$ | 5-$CO_2C_{12}H_{25}$ | 4,5-di-Cl |
| Y-13 | $(CH_3)_3C$ | $CH_3$ | $CH_3O$ | 4-$CO_2C_{10}H_{21}$ | 4-$CO_2CH_2C_6H_5$ |
| Y-14 | $(CH_3)_3C$ | $CH_3$ | $CH_3O$ | 5-$SO_2NHC_{12}H_{25}$ | 4-$CO_2CH_3$ |
| Y-15 | $(CH_3)_3C$ | $CH_3$ | $(CH_3)_2CHO$ | 5-$CO_2C_{12}H_{25}$ | 4-$CO_2$-cyclo-$C_6H_{11}$ |
| Y-16 | $(CH_3)_3C$ | $CH_3$ | cyclo-$C_6H_{11}O$ | 5-$CO_2C_{12}H_{25}$ | 4-$CO_2CH_3$ |
| Y-17 | $(CH_3)_3C$ | $CH_3$ | $CH_3O$ | 5-$CO_2C_{12}H_{24}OCH_3$ | 4-$CO_2CH_3$ |
| Y-18 | $(CH_3)_3C$ | $CH_3$ | Cl | 5-$CO_2C_{16}H_{33}$ | 5-$SO_2N(CH_3)_2$ |
| Y-19 | $(CH_3)_3C$ | $CH_3$ | Cl | 5-$CO_2C_{16}H_{33}$ | 4-$SO_2N(C_2H_5)_2$ |
| Y-20 | $(CH_3)_3C$ | $CH_3$ | Cl | 5-$CONHC_{12}H_{25}$ | 4-$CON(C_2H_5)_2$ |
| Y-21 | $(CH_3)_3C$ | $CH_3$ | Cl | 5-$CONHC_6H_4$-p-$C_{16}H_{33}$ | 4-$CO_2CH_2C_6H_5$ |

TABLE II

Comparison Couplers

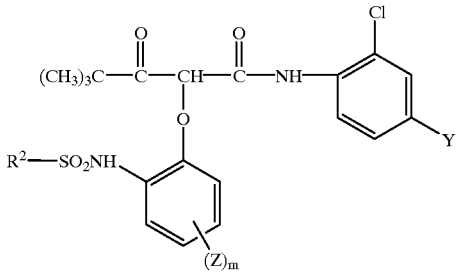

| Coupler | Y | Z | Reference |
|---|---|---|---|
| CY-1 | $NHCO(CH_2)_3O—C_6H_4$-2,4-di-t-pentyl | $4-CO_2CH_3$ | U.S. Pat. No. 4,401,752 |
| CY-2 | $NHCO(CH_2)_3O—C_6H_4$-2,4-di-t-pentyl | $4-SO_2CH_3$ | |
| CY-3 | $NHCO(CH_2)_3O—C_6H_4$-2,4-di-t-pentyl | $4-CO_2CH_3$ | U.S. Pat. No. 4,401,752 |
| CY-4 | $NHCO(CH_2)_3O—C_6H_4$-2,4-di-t-pentyl | H | |
| CY-5 | $NHSO_2C_{12}H_{25}$ | $4-CO_2CH(CH_3)_2$ | U.S. Pat. No. 4,791,050 |
| CY-6 | $CO_2C_{16}H_{33}$ | H | |
| CY-7 | $CO_2C_{16}H_{33}$ | H | |

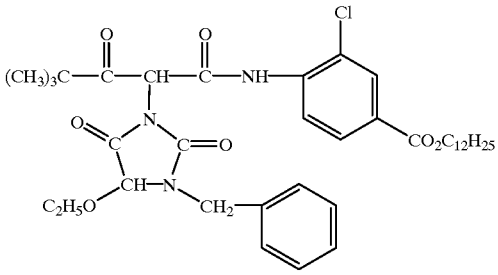

In the exemplary couplers Y-1 to Y-21 of the invention listed in Table I above, Y and Z in each case represents a substituent having a Hammett $sigma_{para}$ constant greater than zero, i.e., an electron-withdrawing substituent. Among the comparison couplers listed in Table II, on the other hand, the Y substituents in CY-1 through CY-4 are not electron-withdrawing. In addition, CY-5 lacks a sulfonamido group in the 2-position of the aryloxy coupling-off group. CY-4,CY-6, and CY-7 all lack Z substituents in their aryloxy coupling-off groups, and the coupling-off group in CY-8 is not an aryloxy moiety.

Photographic Evaluation

Photographic elements are prepared and tested by procedures similar to those described in U.S. Pat. No. 4,401,752, the disclosure of which is incorporated herein by reference. Yellow dyes are formed upon processing of exposed photographic elements using a developer solution containing the color developing agent 4-amino-3-methyl-N-ethyl,N-β-methanesulfonamidoethylaniline sulfate. Maximum densities ($D_{max}$) to blue light and density losses from D=1.0 under conditions of elevated temperature and humidity are measured using exposed and processed photographic elements containing couplers of the invention and the prior art. The results are presented in Tables III and IV below:

TABLE III

| Coupler | Type | Dmax | Dark/Wet Stability at D = 1.0 2 weeks, 60° C., 70% RH |
|---|---|---|---|
| Y-1 | Invention | 2.98 | +2% |
| CY-1 | Comparison | 2.86 | +1% |
| CY-2 | Comparison | 1.06 | +2% |
| CY-3 | Comparison | 0.36 | — |
| CY-4 | Comparison | 2.17 | −6% |

TABLE IV

| Coupler | Type | Dmax | Dark/Wet Stability at D ≈ 1.0 6 weeks, 60° C., 70% RH |
|---|---|---|---|
| Y-1 | Invention | 2.98 | −5% |
| CY-5 | Comparison | 2.81 | −27% |
| CY-6 | Comparison | 2.69 | −25% |
| CY-7 | Comparison | 1.89 | −39% |
| CY-8 | Comparison | 2.03 | −2% |

As shown by the data included in Tables III and IV above, coupler Y-1 produces a higher maximum dye density than any of the comparison couplers. Furthermore, the dye produced from coupler Y- 1 shows excellent resistance to degradation under conditions of elevated temperature and humidity. The benefit of high coupling activity combined with excellent long-term wet heat stability of the resulting dye is especially striking in the data recorded in Table IV.

The invention has been described in detail with particular reference to certain preferred embodiments thereof, but it will be understood that variations and modifications can be effected within the spirit and scope of the invention.

What is claimed:

1. A color photographic element comprising a support, a silver halide emulsion layer, and associated therewith a yellow dye-forming coupler having the formula

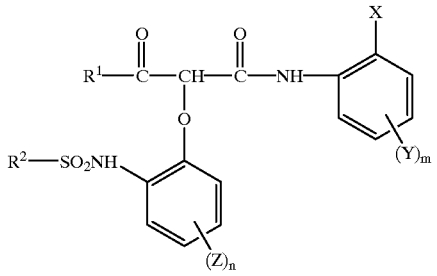

wherein $R^1$ represents a tertiary butyl group;

$R^2$ represents an alkyl, aryl, or heterocyclic group;

X represents hydrogen or a substituent;

Y and Z each independently represent a group consisting of those substituents having a Hammett $sigma_{para}$ constant greater than zero in which Z represents a substituent selected from a carbamoyl group, a sulfamoyl group, a trifluoromethyl group, a cyano group, and halogen; and m and n is each 1 to 4.

2. The color photographic element of claim 1 wherein $R^2$ represents an alkyl group containing 1 to about 8 carbon atoms or an aryl group containing 6 to about 10 carbon atoms.

3. The color photographic element of claim 1 wherein X represents hydrogen or a substituent selected from the group consisting of halogen, an alkoxy group, and a cycloalkoxy group.

4. The color photographic element of claim 3 wherein X represents chlorine or a methoxy group.

5. The color photographic element of claim 1 wherein Y represents a substituent selected from the group consisting of a carboalkoxy group, a carbamoyl group, a sulfamoyl group, and a cyano group.

6. The color photographic element of claim 5 wherein Y represents a carboalkoxy group containing up to about 20 carbon atoms.

7. The color photographic element of claim 1 wherein Z represents a substituent selected from the group consisting of a carboalkoxy group, a carbamoyl group, a sulfamoyl group, a trifluoromethyl group, a cyano group, and halogen.

8. The color photographic element of claim 1 wherein Y and Z each independently represent a group consisting of those substituents haing a Hammett $sigma_{para}$ constant greater then +0.2.

9. The color photographic element of claim 1 wherein the yellow dye-forming coupler is selected from the group consisting of couplers having the general formula and specific substituents as indicated below:

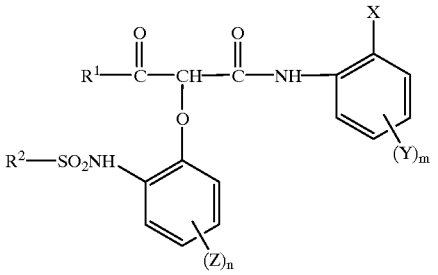

wherein $R^1$ is a tertiary butyl group;

$R^2$ an alkyl group containing 1 to about 8 carbon atoms or an aryl group containing 6 to about 10 carbon atoms;

X is hydrogen or a substituent selected from the group consisting of halogen, an alkoxy group, and a cycloalkoxy group;

Y is a substituent selected from the group consisting of a carboalkoxy group, a carbamoyl group, a sulfamoyl group, and a cyano group;

Z is a substituent selected from the group consisting of a carboalkoxy group, a carbamoyl group, a sulfamoyl group, a trifluoromethyl group, a cyano group, and halogen.

10. A color photographic element comprising a support, a silver halide emulsion layer, and associated therewith a yellow dye-forming coupler having the formula:

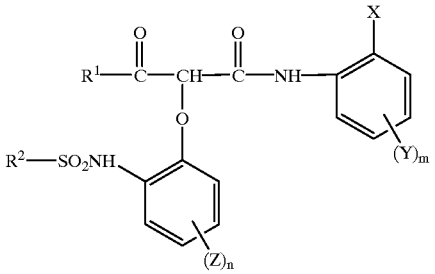

wherein $R^1$ represents a tertiary butyl group;

$R^2$ represents an alkyl, aryl, or heterocyclic group;

X represents a chloro or methoxy group;

Y and Z each independently represent a group consisting of those substituents having a Hammett $sigma_{para}$ constant greater than zero; and m and n is each 1 to 4.

11. The element of claim 10 wherein X is a chloro group.

12. The element of claim 10 wherein X is a methoxy group.

* * * * *

UNITED STATES PATENT AND TRADEMARK OFFICE

CERTIFICATE OF CORRECTION

PATENT NO. : 6,162,598
DATED : December 19, 2000
INVENTOR(S) : Ping-Wah Tang, Robert G. Cameron It is certified that error appears in the above-identified patent and that said Letters Patent is hereby corrected as shown below:

Column 21, claim 7,
Line 13, delete in its entirety and substitute new claim 7 as follows:

7. The color photographic element of claim 1 wherein m and n are each 1.

Signed and Sealed this

Twentieth Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,162,598
DATED : December 19, 2000
INVENTOR(S) : Ping-Wah Tang, Robert G. Cameron It is certified that error appears in the above-identified patent and that said Letters Patent is hereby corrected as shown below:

Column 21, claim 7,
Line 13, delete in its entirety and substitute new claim 7 as follows:

7. The color photographic element of claim 1 wherein m and n are each 1.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*